United States Patent [19]

Fett et al.

[11] 4,006,400

[45] Feb. 1, 1977

[54] REFERENCE VOLTAGE REGULATOR

[75] Inventors: Darrell L. Fett, Scottsdale, Ariz.; David E. Fulkerson; Marvin L. Geske, both of Minnetonka, Minn.

[73] Assignee: Honeywell Information Systems, Inc., Waltham, Mass.

[22] Filed: Mar. 26, 1975

[21] Appl. No.: 562,277

[52] U.S. Cl. ..... 323/19; 323/22 T; 330/30 D

[51] Int. Cl.[2] ..... G05F 1/44

[58] Field of Search ..... 323/1, 4, 16, 19, 22 T; 330/30 D, 28; 307/255

[56] References Cited

UNITED STATES PATENTS

| | | | |
|---|---|---|---|
| 3,470,457 | 9/1969 | Howlett | 323/22 T |
| 3,529,182 | 9/1970 | Jornod | 323/19 |
| 3,538,424 | 11/1970 | Frederiksen | 323/22 T |
| 3,617,859 | 11/1971 | Dobkin et al. | 323/22 T |
| 3,688,128 | 8/1972 | Van Essen et al. | 330/30 D |
| 3,735,242 | 5/1973 | Anderson | 323/22 T |
| 3,805,145 | 4/1974 | Gordon | 323/16 |
| 3,848,179 | 11/1974 | Kayama | 323/22 T |

*Primary Examiner*—Gerald Goldberg
*Attorney, Agent, or Firm*—William F. White; Ronald T. Reiling

[57] ABSTRACT

A novel voltage reference regulator is disclosed which operates in a relatively low voltage environment so as to effectively control an electrical potential subject to some relatively large current fluctuations. The voltage reference regulator comprises a voltage amplifier operating in conjunction with a low impedance output circuit so as to counteract the current fluctuations. The voltage amplifier consists of two differential amplifying stages whereas the output circuit comprises a dual transistor Darlington configuration.

6 Claims, 2 Drawing Figures

REFERENCE VOLTAGE REGULATOR

BACKGROUND OF THE INVENTION

1. Field of the Invention

This invention relates generally to the controlled regulation of an electric potential. In particular, this invention relates to the control of an electric potential at relatively low voltage levels.

2. Description of the Prior Art

It has heretofore been known to regulate critical electrical signal conditions within various electronic apparatus. Such signal regulation has usually been required to meet the stringent conditions of the electronic environment in which the electrical signal condition is found. The demands which are placed upon controlling a signal become particularly difficult in a relatively low voltage environment. Matters are even further compounded when the signal condition to be controlled varies considerably in the low voltage environment. To the extent that signal control systems can be designed for operation in such an environent, the same usually require extensive circuitry comprising a considerable number of circuit elements.

OBJECTS OF THE INVENTION

Accordingly, it is a general object of this invention to provide an improved signal regulating system.

A particular object of this invention is to provide an electronic signal regulating system which operates at relatively low voltages so as to regulate an electrical potential in a particularly demanding environment.

Still another object of this invention is to provide an electrical potential regulating system comprising a simplified circuit configuration with a relatively small amount of electronic apparatus.

SUMMARY OF THE INVENTION

The above objects are achieved according to the present invention by providing a reference voltage regulator which controls a relatively low voltage in such a manner so as to counteract relatively high current fluctuations resulting from the environment in which the low voltage is to be regulated in. The reference voltage regulator comprises a voltage amplifier operating in closed loop conjunction with a low-impedance current output circuit. The voltage amplifier consists of two differential stages of voltage gain whereas the output circuit comprises a two-transistor output stage for current gain. The reference voltage regulator further comprises circuitry immediate to the output circuit for referencing the voltage is to be controlled.

BRIEF DESCRIPTION OF THE DRAWINGS

For a better understanding of the present invention, reference should be made to the accompanying drawings wherein.

DESCRIPTION OF THE PREFERRED EMBODIMENT

Figure 1:
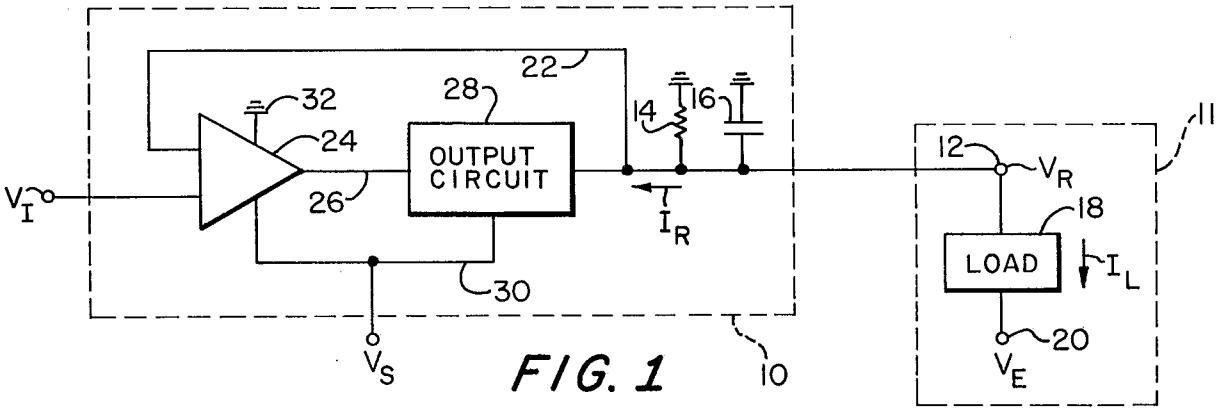
FIG. 1 schematically depicts the voltage reference regulator in block diagram form.

Referring to FIG. 1, a voltage reference regulator 10 denoted by the dotted outline form 10 regulates a reference voltage $V_R$ appearing in an external circuit 11 at a terminal 12. The reference voltage $V_R$ is so regulated so as to remain equal to the voltage $V_1$ applied to the input of the voltage reference regulator. The so-regulated voltage, $V_R$, is referenced to ground within the voltage reference regulator by a reference resistor 14. A capacitor 16 in parallel with the reference resistor 14 compensates for any high frequency transient effects which might occur in the external circuit 11 thereby affecting the voltage $V_R$ across the reference resistor 14.

Turning now to the external circuit 11, the reference voltage $V_R$ represents a relatively higher voltage with respect to a load 18 connected to a downstream terminal 20 having a relatively lower voltage $V_E$. It is to be noted that $V_R$ and $V_E$ are both negative potentials with respect to ground with $V_E$ being the more negative. It is to be furthermore noted that the load 20 may comprise a considerable amount of electronic apparatus including any number of small integrated circuits. Such a load must operate in a pre-defined low voltage environment equal to that of $V_R - V_E$. In this regard, it becomes extremely important that the particular voltage environment relative to the load 18 remain as nearly constant as is possible. This is accomplished by counteracting any fluctuations in the load current $I_L$ by a counter regulator current $I_R$ produced within the voltage regulator 10.

The regulator current $I_R$ is produced within the voltage reference regulator 10 by virtue of the reference voltage $V_R$ being fed back over a line 22 to the inverting input of a voltage amplifier 24. Any error between the fedback voltage $V_R$ and the input voltage $V_I$ to the amplifier 24 is amplified and transmitted over a line 26 to an output circuit 28. The output circuit 28 in response to the amplified error produces a current $I_R$ to counteract the current fluctuations of $I_L$. This counteractive measure continues until $V_R$ again equals $V_I$. The voltage is thereby caused to follow the input voltage $V_I$ by the closed loop control of $I_R$.

Regarding the amplifier 24 and the output circuit 28, it is to be noted that both connect to a bus 30 supplying a voltage $V_S$. The amplifier 24 is furthermore connected to a ground terminal 32. The signal polarity is such that $V_S$ is negative relative to the ground terminal 32.

Figure 2:
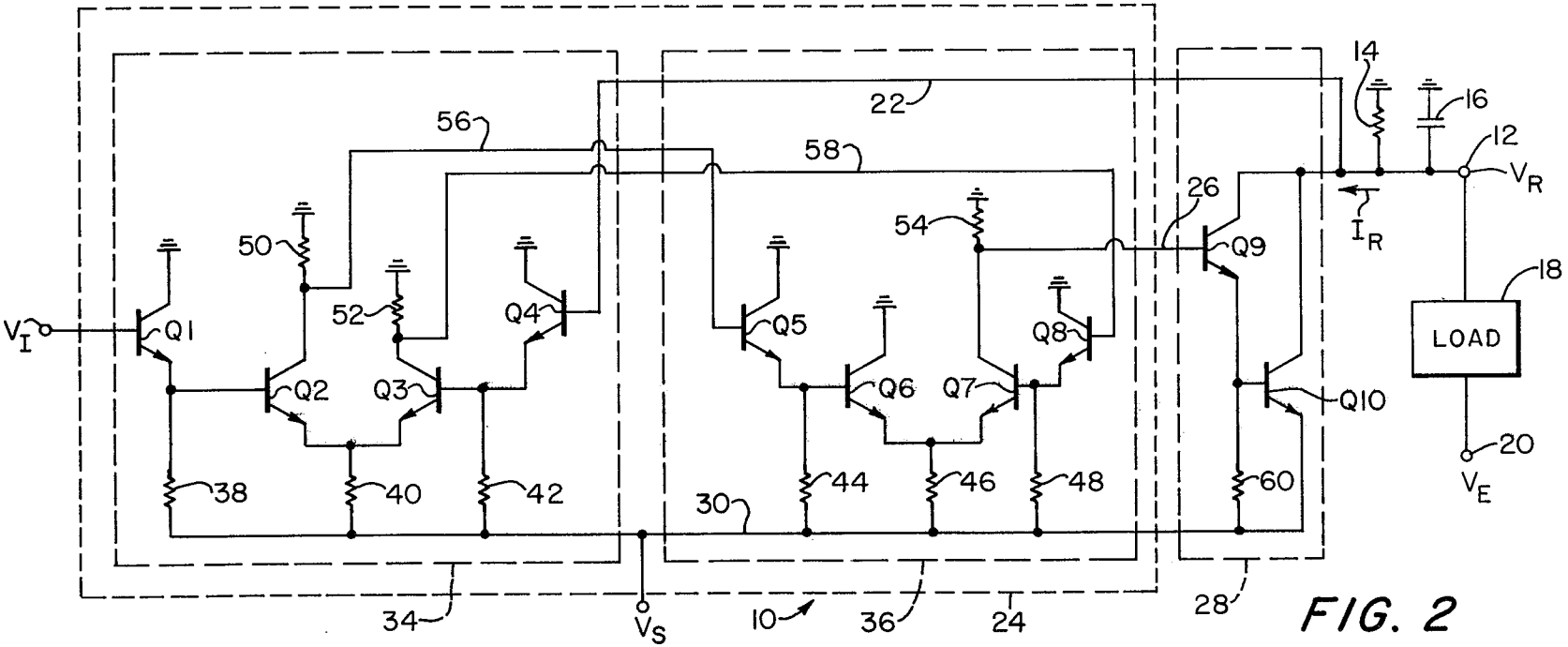
FIG. 2 illustrates the detailed electronic elements of the block diagrammed voltage reference regulator of FIG. 1.

Referring now to FIG. 2, wherein the voltage reference regulator 10 is shown in greater detail with the various elements of FIG. 1 being similarly labelled. In particular, it is to be noted that the amplifier 24 and the output circuit 28 comprise considerable detailed circuitry. Beginning with the amplifier 24, it is seen that the amplifier consists of two differential amplifying stages 34 and 36 each of which is separately denoted in dotted block outline form. The first amplifying stage 34 consists of a pair of emitter follower input transistors Q1 and Q4 and a pair of differentially connected emitter follower output transistors Q2 and Q3. The second amplifying stage 36 consists of a pair of emitter follower input transistors Q5 and Q8 and a pair of differentially connected emitter follower transistors Q6 and Q7. The emitter terminals of all of the transistors Q1 through Q8 are seen to be connected through one of the resistors 38 through 48 to the voltage supply bus 30. The voltage $V_S$ on the supply bus 30 is at a negative level with respect to ground. The various current paths for the transistors are therefore seen to be from a collector point of relatively higher voltage through one of the particular emitter resistance paths to the voltage level $V_S$ on the supply bus 30. The upstream collector voltage level for Q1, Q4, Q5, Q6 and Q8 is ground or zero volts. The collector voltage levels relative to ground for Q2, Q3, Q7 are established by their respective collector resistances 50, 52 and 54.

The inputs to the first differential amplifying stage 34 are seen to be $V_I$ at the base of the input transistor Q1, and the fedback $V_R$ from the line 22 appearing at the base of the transistor Q4. The normal voltage levels of $V_I$ and $V_R$ are such as the cause the input transistors Q1 and Q4 to continually conduct. The transistors Q1 and Q4 are emitter followers providing a high input impedance and a low output impedance for driving the differential paired transistors Q2 and Q3. The differetial paired transistors Q2 and Q3 which are continually conducting actually shift currents between them depending on the differential in the voltage between their respective bases. This results in a differential voltage across the respective collector terminals which serves as the respective output voltage to the differential amplifying stage 36. It is to be noted that since both differential paired transistors Q2 and Q3 are conducting the polarity of the voltage change across each respective collector resistor is opposite thereby giving opposite polarity amplification at each collector terminal. By taking the differential thereof, a double amplification is accomplished with the gain of such amplification being set by the respective collector resistors 50 and 52.

The outputs from the differential stage 34 are connected to the input transistors Q5 and Q8 of the second differential amplifying stage 36 via lines 56 and 58 respectively. It is to be noted that the differential output from the first amplifying stage 34 maximizes the gain by a factor of two in the feed through to the second differential amplifying stage 36. This is of course accomplished with reduced complexity by virtue of the double-ended feed in the lines 56 and 58. The second differential amplifying stage 36 has basically two functions: one being to provide additional gain and the second being for an appropriate level shifting. In other words, the high-gain from the first amplifying stage is shifted to a voltage compatible with the output circuit 20. This is accomplished again by the set of input transistors Q5 and Q8 causing the differentially paired transistors Q6 and Q7 to shift currents between them in response to the differential output from the first amplifying stage over the lines 56 and 58. It is to be noted that the transistors Q5 through Q8 are normally conductive within their respective linear ranges in much the same manner as the transistors Q1 through Q4.

A single-ended output line 26 connected to the collector side of the transistor Q7 constitutes a final output voltage for the high-gain amplifier 36. As has been previously mentioned, this final output voltage is set at a level compatible with that of the output circuit 20. This is accomplished by an appropriate choice of the resistor 54.

The output circuit 20 comprises a Darlington connection of normally conductive transistors Q9 and Q10. The resistor 60 defines the voltage level for the base of the transistor Q10. The current amplifying effect of the output circuit 20 is such as to first of all cause the transistor Q9 to conduct in response to the amplified voltage error on the line 22. The current through Q9 is again amplified by Q10 so that two stages of current gain are realized from the Darlington configuration. The simultaneous conduction of both transistors Q9 and Q10 produces a voltage reference regulator current $I_R$ in response to the amplified voltage difference between $V_R$ and $V_I$.

As has been previously explained, the reference resistor 14 references the instantaneous value of the reference voltage $V_R$. In a dynamic condition, the current surge from the load can produce instantaneous changes in the voltage $V_R$. Since the voltage reference regulator cannot respond to instantaneous changes, the capacitor 16 acts to temporarily absorb the high frequency load current effects. This change in $V_R$ is thereafter replenished by the normal closed loop control of $I_R$.

The values of the resistor 14 and the capacitor 16 can be chosen depending on the voltage reference level $V_R$ and the range of load currents $I_L$. In this regard, values for a preferred embodiment for maintaining the reference voltage level $V_R$ at −0.26 volts within a load current range of 30 to 300 milliamps will now be set forth for a voltage reference regulator 10 having a voltage supply $V_S$ of −3.30 volts:

| Resistor Elements | Resistance Values |
|---|---|
| 14 | .82 ohms |
| 38 | 2.2K ohms |
| 40 | 180 ohms |
| 42 | 2.2K ohms |
| 44 | 2.2K ohms |
| 46 | 90 ohms |
| 48 | 2.2K ohms |
| 50 | 225 ohms |
| 52 | 225 ohms |
| 54 | 325 ohms |

The capacitance for the capacitor 16 should be sufficient to absorb any high current excursions so as to hold the voltage $V_R$ relatively constant until such time as the regulator can respond.

Having now described the circuitry in FIG. 2, it is now appropriate to turn to an example of how the various circuit elements operate so as to provide the appropriate regulation of the voltage reference $V_R$. Assuming that $V_R$ is higher than the preferred setting of −0.26 volts and is presently −0.20 volts. For $V_R$ higher than usual, the base of Q4 will be drawn higher thereby causing increased conductivity in Q4. This increased conductivity in Q4 causes Q3 to conduct more than Q2 thereby causing an increased voltage drop across resistor 52 and a decreased voltage drop across resistor 50. This will result in the voltage downstream of resistor 52 appearing on the line 58 to be more negative than usual. This will also result in the voltage downstream of the resistor 50 appearing on the line 56 being less negative than usual, the base of Q5 is drawn higher thereby causing Q5 to increasingly conduct. This Q5 conduction causes Q6 to be more conductive than Q7 which causes the latter's collector voltage downstream of the resistor 54 to be higher or more positive than usual. This increased voltage level appears on the single-ended output line 26 which draws the base of Q9 high enough to appropriately conduct thereby pulling current $I_R$ through the reference resistor 14. The conduction of Q9 also causes Q10 to appropriately conduct thereby causing further current $I_R$ to be pulled through the resistor 14. This current increase through the resistor 14 causes $V_R$ to become more negative thereby decreasing the original $V_R$ of −0.20 volts until the preferred voltage $V_I$ of −0.26 volts is achieved.

What is claimed is:

1. A system for regulating voltage, said system comprising:

means for referencing the voltage to be regulated;

means for comparing the referenced voltage to be regulated with a predefined voltage to be followed, said comparing means being operative to produce an error signal indicative of any difference between the compared voltages, said means for comparing voltages comprising a two stage differential amplifier, said first stage of amplification comprising:

means for receiving the input voltage conditions to said comparing means, wherein the input voltage conditions comprise the voltage to be regulated and the predefined voltage to be followed, said receiving means comprising a pair of emitter-follower transistors, each having a base connected to one of the input voltage conditions, and a pair of differentially connected transistors each of which is base-connected to a corresponding normally conductive emitter terminal of one of said pair of emitter-follower transistors within said means for receiving the input voltage conditions, said pair of differentially connected transistors both being conductive in response to a difference in the two voltages received by said pair of emitter-follower transistors, said pair of differentially connected transistors forming a double-ended differential output, and means responsive to said error signal and attached to said referencing means for inducing a change in the voltage to be regulated as the same appears on said referencing means.

2. The system of claim 1 wherein said second stage of amplification comprises:

means for receiving the double-ended output of said first stage of amplification comprising a pair of emitter-follower transistors each of which is base-connected to a respective end of the double-ended output of said first stage of amplification, and a pair of differentially connected transistors each of which is base-connected to a corresponding normally conductive emitter terminal of one of said pair of emitter follower transistors within said means for receiving the double-ended differential output of said first stage, said differentially connected transistors both being conductive in response to a differential output signal from said first stage.

3. The system of claim 2 wherein all of said emitter-follower transistors have respective collector paths emanating from a first constant voltage level above that of the predefined voltage to be followed and furthermore have respective emitter paths terminating at a voltage level below that of the voltage to be followed.

4. The system of claim 2 wherein said means responsive to said error signal and attached to said referencing means for inducing a change in the voltage to be regulated comprises:

means for drawing current from said means for referencing the voltage to be regulated.

5. The system of claim 4 wherein said means for drawing current comprises:

a first transistor having a base connected to said comparing means and being operative to conduct from said referencing means for referencing the voltage to be regulated to a voltage level lower than the voltage to be regulated.

6. The system of claim 5 wherein said means for drawing current further comprises:

a second transistor base-connected to the output side of said first transistor, said second transistor being furthermore connected between the voltage to be regulated and the lower voltage level and being operative to amplify the amount of current being drawn from the means for referencing the voltage to be regulated.

* * * * *